US005971718A

United States Patent [19]

Krueger et al.

[11] Patent Number: 5,971,718

[45] Date of Patent: Oct. 26, 1999

[54] METHOD AND APPARATUS FOR REGULATING A VOLUMETRIC FUEL FLOW BETWEEN A FEED PUMP AND A HIGH-PRESSURE PUMP

[75] Inventors: Hinrich Krueger; Dirk Baranowski, both of Regensburg; Christian Birkner, Langquaid, all of Germany

[73] Assignee: Siemens Aktiengesellschaft, Muenchen, Germany

[21] Appl. No.: 08/854,204

[22] Filed: May 9, 1997

[30] Foreign Application Priority Data

May 9, 1996 [DE] Germany ..... 196 18 707

[51] Int. Cl.[6] ..... F04B 49/24

[52] U.S. Cl. ..... 417/286

[58] Field of Search ..... 417/286, 288, 417/297, 251, 304, 308

[56] References Cited

U.S. PATENT DOCUMENTS

| | | | |
|---|---|---|---|
| 2,653,543 | 9/1953 | Mott | 103/5 |
| 3,620,648 | 11/1971 | Hofer | 417/293 |
| 4,445,818 | 5/1984 | Ohsaki et al. | 417/288 |
| 4,478,043 | 10/1984 | Kobavashi et al. | 60/608 |
| 4,519,413 | 5/1985 | Wagenseil et al. | 137/111 |
| 4,541,385 | 9/1985 | Eheim et al. | 123/446 |
| 4,591,317 | 5/1986 | Markunas | 417/288 |
| 4,884,545 | 12/1989 | Mathis | 123/447 |
| 4,895,184 | 1/1990 | Abbey | 137/625.29 |
| 4,986,738 | 1/1991 | Kawasaki et al. | 417/304 |
| 5,416,701 | 5/1995 | Kawabata | 364/424.05 |

FOREIGN PATENT DOCUMENTS

| | | |
|---|---|---|
| 0299337A2 | 1/1989 | European Pat. Off. . |
| 1453580 | 6/1974 | Germany . |
| 19612412A1 | 10/1997 | Germany . |

*Primary Examiner*—Charles G. Freay
*Assistant Examiner*—Robert Z. Evora
*Attorney, Agent, or Firm*—Herbert L. Lerner; Laurence A. Greenberg

[57] ABSTRACT

A method and an apparatus for regulating a volumetric fuel flow regulate a fuel flow delivered by a feed pump to a high-pressure pump of an injection system as a function of a volumetric fuel discharged from a high-pressure reservoir through a high-pressure regulating valve. The regulation is effected through the use of a pressure regulating valve or a volumetric flow regulating valve.

7 Claims, 3 Drawing Sheets

METHOD AND APPARATUS FOR REGULATING A VOLUMETRIC FUEL FLOW BETWEEN A FEED PUMP AND A HIGH-PRESSURE PUMP

BACKGROUND OF THE INVENTION

Field of the Invention

The invention relates to a method for regulating a volumetric fuel flow delivered by a feed pump to a high-pressure pump connected to a high-pressure reservoir. The invention also relates to an apparatus for regulating the volumetric fuel flow delivered by a feed pump to a high-pressure pump.

Regulating a volumetric fuel flow in an inflow to a high-pressure pump, which pumps fuel into a high-pressure reservoir of a common rail injection system of an internal combustion engine, requires optimized adaptation, since on one hand it must be assured that the high-pressure pump is supplied with enough fuel to suit the engine operating conditions, and on the other hand, the high-pressure pump should nevertheless not pump excess fuel into the high-pressure reservoir, since the excess fuel is returned to the engine tank through a high-pressure valve and thus causes warming of the fuel in the tank. In addition, fuel is highly compressed unnecessarily by the high-pressure pump as a result, which represents an unnecessary power loss.

Published European Patent Application 0 299 337 A2 describes a method and an apparatus for regulating the volumetric fuel flow that is supplied by a feed pump to a high-pressure pump. A regulatable throttle that is triggered by a control unit is disposed between the feed pump and the high-pressure pump. An arithmetic unit monitors the fuel pressure in the high-pressure reservoir and controls the regulatable throttle in accordance with the fuel demand of the engine and the fuel pressure in the high-pressure reservoir.

Regulating the fuel pressure in the high-pressure reservoir is relatively complicated. In that method both the fuel pressure and the expected consumption by the engine must be ascertained and an opening cross section of the regulatable throttle must be calculated by the arithmetic unit from those variables.

SUMMARY OF THE INVENTION

It is accordingly an object of the invention to provide a method and an apparatus for regulating a volumetric fuel flow, which overcome the hereinafore-mentioned disadvantages of the heretofore-known methods and apparatuses of this general type, which are simple and which can be used for regulating the volumetric fuel flow of a feed pump for a high-pressure pump.

With the foregoing and other objects in view there is provided, in accordance with the invention, a method for regulating a volumetric fuel flow delivered by a feed pump to a high-pressure pump connected to a high-pressure reservoir, which comprises draining fuel from the high-pressure reservoir, beyond a limit pressure, through a high-pressure valve; and regulating the volumetric fuel flow between the feed pump and the high-pressure pump as a function of a quantity of the fuel drained out.

In accordance with another mode of the invention, there is provided a method which comprises regulating the volumetric fuel flow by varying fuel pressure between the feed pump and the high-pressure pump.

In accordance with a further mode of the invention, there is provided a method which comprises regulating the volumetric fuel flow by varying fuel pressure between the feed pump and the high-pressure pump and by varying a cross section of a connecting line between the feed pump and the high-pressure pump.

With the objects of the invention in view, there is also provided an apparatus for regulating a volumetric fuel flow delivered by a feed pump to a high-pressure pump, comprising a housing having a piston chamber therein and having a continuous reference conduit therein communicating with the piston chamber; an inflow conduit and an outflow conduit communicating with the piston chamber; and a movable control piston in the piston chamber, the control piston having a first piston part and a second piston part operatively connected to the first piston part; the first piston part operatively connected to the reference conduit and sealing off the reference conduit from the piston chamber; the second piston part having a position of repose opening a predeterminable connecting cross section between the inflow conduit and the outflow conduit; the first piston part being displaced with increasing pressure in the reference conduit for exerting a force upon the second piston part displacing the second piston part to increase the connecting cross section between the outflow conduit and the inflow conduit.

In accordance with another feature of the invention, the second piston part has a larger diameter than the first piston part; the reference conduit and the inflow conduit define a first region therebetween; the first piston part protrudes into the reference conduit and seals off the piston chamber in the first region; the inflow conduit discharges into the piston chamber in a second region; the piston chamber has a larger diameter than the first piston part in the second region; the first piston part extends beyond the second region; the first piston part is connected directly to the second piston part; the second piston part is adapted to the piston chamber for sealing off the piston chamber with the second piston part; the control piston has a position of repose in which the second piston part partly opens the outflow conduit; and there is provided a spring element associated with the control piston; the control piston being displaceable by fuel pressure in the reference conduit counter to the spring element, causing the second piston part to open a larger opening cross section between the outflow conduit and the piston chamber.

In accordance with a further feature of the invention, there is provided a first spring element resiliently supporting the first piston part; a second spring element interconnecting the second piston part and the first piston part; a third spring element resiliently supporting the second piston part counter to a motion in the direction of the reference conduit; a regulating chamber disposed between the first and second piston parts in the piston chamber and sealed off by the first and second piston parts; the inflow conduit discharging into the regulating chamber and the outlet conduit leading away from the regulating chamber; the first and second piston parts and the first, second and third spring elements causing the outlet conduit to be opened to a predeterminable cross section as a function of fuel pressure in the reference conduit; and the outflow conduit opening to a predeterminable further cross section.

In accordance with an added feature of the invention, there is provided a supply line connecting the feed pump to the high-pressure pump, a connecting line connecting the inflow conduit to the connecting line, a high-pressure reservoir, an outlet line connected between the high-pressure reservoir and the reference conduit, a high-pressure valve in the outlet line, and a tank with which the outflow conduit and the reference conduit communicate.

In accordance with an additional feature of the invention, there is provided a supply line connected to the feed pump and to the inflow conduit, a supply line connected from the outlet conduit to the high-pressure pump, an outlet line connected between a high-pressure region of an injection system and the reference conduit, a high-pressure valve in the outlet line, and a tank with which the outflow line and the reference conduit communicate.

In accordance with yet another feature of the invention, there is provided a throttle through which the reference conduit communicates with the outflow conduit.

With the objects of the invention in view there is additionally provided an apparatus for regulating a volumetric fuel flow delivered by a feed pump to a high-pressure pump, comprising a housing having a piston chamber therein; an inflow conduit and an outflow conduit offset from one another longitudinally of the piston chamber, the inflow and outflow conduits communicating with the piston chamber and each having a mouth; a movable control piston disposed in the piston chamber between the mouth of the outflow conduit and the mouth of the inflow conduit, the control piston having a position of repose opening a predeterminable connecting cross section between the outflow conduit and the inflow conduit; and a device acting upon the control piston with a reference force exerted toward the inflow conduit for increasingly closing the outflow conduit and raising pressure in the inflow conduit, with an increase in the reference force.

In accordance with another feature of the invention, there is provided a diaphragm operatively connected to the control piston for transmitting the reference force to the control piston.

In accordance with a further feature of the invention, the reference force is generated by charge pressure of a turbocharger of an internal combustion engine.

In accordance with a concomitant feature of the invention, the housing has a connection, and the device includes a piston rod connected to the control piston and extended through a bore to the connection, for transmitting pressure applied at the connection to the control piston through the piston rod.

A simple method and a simple apparatus are attained due to the fact that the volumetric fuel flow to the high-pressure pump is regulated as a function of the volumetric fuel flow with which excess fuel is discharged through a high-pressure valve from the high-pressure region of the injection system. The feed flow of the high-pressure pump is thus adapted to the demand in a simple way by self-regulation.

Other features which are considered as characteristic for the invention are set forth in the appended claims.

Although the invention is illustrated and described herein as embodied in a method and an apparatus for regulating a volumetric fuel flow, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
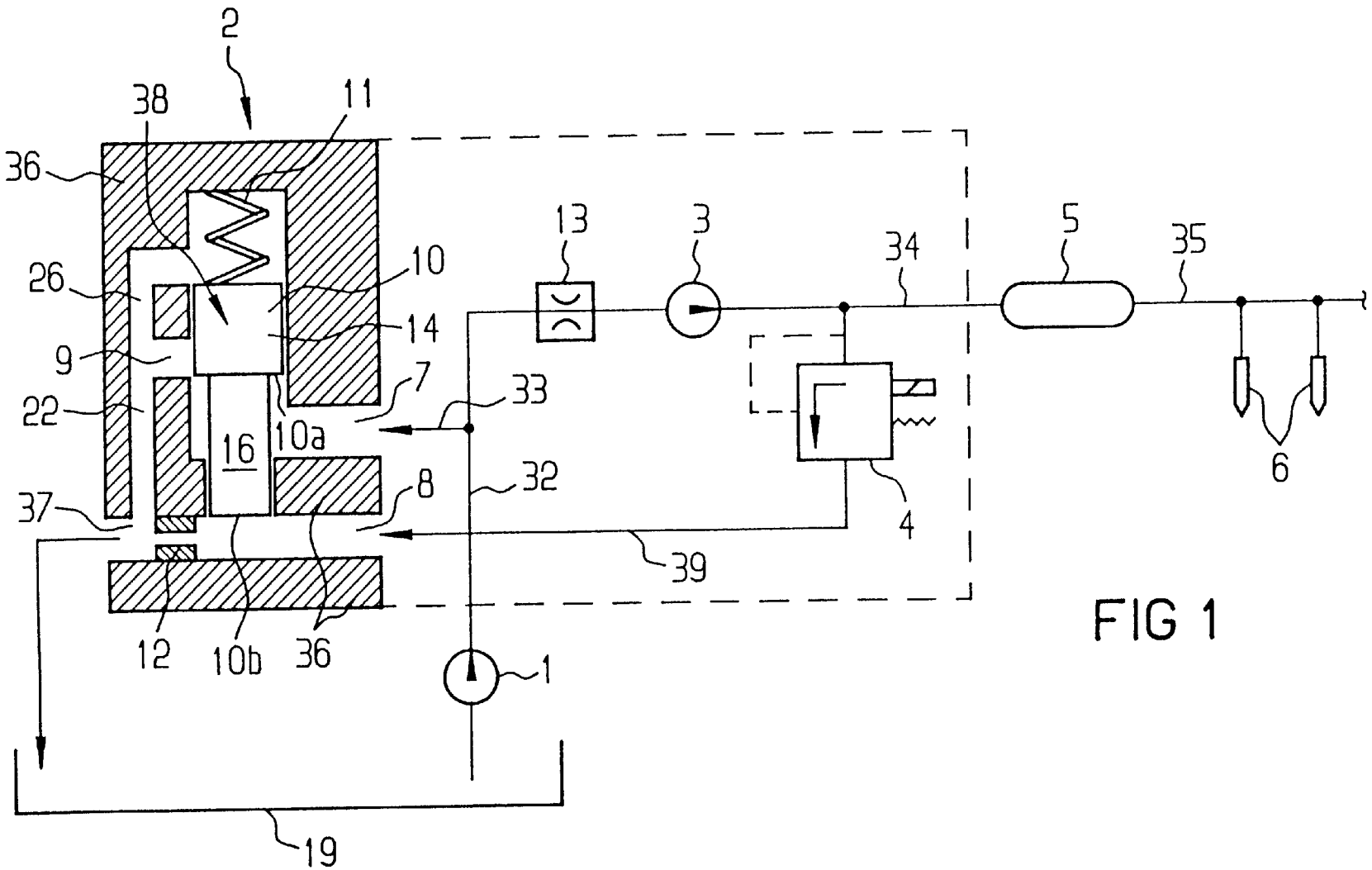
FIG. 1 is a schematic and diagrammatic, cross-sectional view of an apparatus for regulating a volumetric fuel flow with constant throttle cross section and variation of inflow pressure.

Referring now to the figures of the drawings in detail and first, particularly, to FIG. 1 thereof, there is seen a common rail injection system with a feed pump 1 which pumps fuel out of a tank 19 into a feed line 32. The feed line 32 leads through a throttle 13 of constant cross section to a high-pressure pump 3 and also communicates upstream of the throttle 13 through a connecting line 33 with an inflow conduit 7 of a pressure regulating valve 2. The high-pressure pump 3 is connected through a high-pressure line 34 to a high-pressure reservoir 5, which communicates through an injection line 35 with injection valves 6. The high-pressure line 34 communicates through a high-pressure valve 4 and an outlet line 39 with an outlet conduit 8 of the pressure regulating valve 2, which represents a reference conduit. The pressure regulating valve 2 regulates a volumetric fuel flow that is made available to the high-pressure pump 3 by the feed pump 1 by varying a pressure of fuel in the feed line 32 in the inflow to the throttle 13, as a function of the volumetric fuel flow that is discharged by the high-pressure valve 4. An outlet conduit 37 of the pressure regulating valve 2, which communicates with the outlet conduit 8 through an outlet aperture 12, is connected to the tank 19.

The structure of the pressure regulating valve 2 will now be described in detail: The pressure regulating valve 2 has a housing 36, into which the inflow conduit 7 and the outlet conduit 8 are introduced. The inflow conduit 7 and the outlet conduit 8 are parallel to one another, and a piston chamber 38 which connects the inflow conduit 7 and the outlet conduit 8 with one another extends perpendicular to the inflow conduit 7 and the outlet conduit 8. A movable control piston 10 is introduced into the piston chamber 38, extends past the inflow conduit 7 toward the outlet conduit 8, and is resiliently supported against the housing 36 by a pressure-holding spring 11, so that the pressure-holding spring 11 counteracts any motion of the control piston 10 toward the inflow conduit 7. A stop is advantageously provided, so that the motion of the control piston 10 toward the outlet conduit is limited. The control piston 10 is adapted to the piston chamber 38, so that the piston chamber 38 is sealed off between the inflow conduit 7 and the outlet conduit 8. The control piston 10 has a first piston part 16 and a second piston part 14 which has a larger diameter than the first piston part 16. The first piston part 16 extends from the outlet conduit 8 through the inflow conduit 7 into an upper region of the piston chamber 38. The upper region of the piston chamber 38 is adapted in its diameter to the second piston part 14 in such a way that the second piston part 14 seals off the upper region of the piston chamber 38. The reference conduit 8 and the inflow conduit 7 define a first region therebetween and the inflow conduit 7 discharges into the piston chamber 38 in a second region.

An outflow conduit 9 is provided in the region of the second piston part 14 and extends laterally into the piston chamber 38 above the inflow conduit 7. This outflow conduit 9 is sealed off in a position of repose of the control piston 10 by the second piston part 14, except for a predeterminable cross-section, and the pressure-holding spring 11 is constructed accordingly. The outflow conduit 9 communicates through a connecting conduit 26 with a region of the piston chamber 38 where the pressure-holding spring 11 is disposed. In addition, the outflow conduit 9 is extended through a return conduit 22 and through the outlet conduit 37 that is connected to the tank 19. The outlet conduit 8 is also extended to the outlet conduit 37, and the outlet aperture 12 is made in the outlet conduit 8 between the region where the control piston 10 protrudes into the outlet conduit 8 and the outlet conduit 37.

The mode of operation of the pressure regulating valve 2 will now be explained: If a fuel pressure in the high-pressure reservoir 5 is below a predetermined desired value, then no fuel is blown out through the high-pressure valve 4. Consequently, the control piston 10 protrudes into the outlet conduit 8 in accordance with the prestressing of the pressure-holding spring 11 and the upper part 14 of the control piston 10 closes the outflow conduit 9 far enough to ensure that the maximum possible pressure, defined by the structure of the pressure-holding spring 11 and a first pressure surface 10a of the piston, is established in the feed line 32 and at the throttle 13. In this way, the excess portion of the volumetric fuel flow pumped by the feed pump 1 is returned to the tank 19 through the outflow conduit 9 and the outlet conduit 37. The volumetric fuel flow to be pumped by the high-pressure pump 3 is supplied to it through the feed line 32 and the throttle 13.

The throttle 13 is dimensioned in such a way that at the maximum possible pressure in the feed line 32 and at low to medium rpm of the high-pressure pump 3, more fuel is admitted than the high-pressure pump 3 requires. The throttle 13 does not become operative until a high rpm of the high-pressure pump 3 and/or until the pressure in the feed line 32 drops, as will be described below:

If the fuel pressure in the high-pressure reservoir 5 and therefore also in the high-pressure line 34 is too high, then fuel is returned through the high-pressure valve 4, the outlet line 39, the outlet conduit 8, the outlet aperture 12 and the outlet conduit 37 to the tank 19. The consequence is that the control piston 10 is displaced counter to the pressure-holding spring 11 by the pressure of the fuel carried in the outlet conduit 8, and thus further opens the connecting cross section between the outflow conduit 9 and the inflow conduit 7. Thus more fuel is returned from the feed line 32, through the inflow conduit 7, the outflow conduit 9 and the outlet conduit 37 to the tank 19. This leads to a lowering of the fuel pressure in the feed line 32 in the inflow to the throttle 13 and thus to a lowering of the volumetric fuel flow that is made available to the high-pressure pumps 3 by the feed pump 1. Thus less fuel is pumped into the high-pressure reservoir 5 by the high-pressure pump 3, and since fuel is simultaneously drawn from the high-pressure reservoir 5 by the injection valve 6, the pressure in the fuel in the high-pressure reservoir 5 is reduced. A pressure reduction in the high-pressure reservoir 5 can also be effected if no fuel is withdrawn by the injection valves 6, since the high-pressure valve 4 can allow more fuel to drain off than is supplied to the high-pressure pump 3.

The pressure conditions will now be described in further detail: The volumetric fuel flow blown off by the high-pressure valve 4 generates a pressure $p_{ab}$ upstream of the outlet aperture 12. This pressure acts upon a second pressure surface 10*b* of the control piston 10 that borders the outlet conduit 8.

The first pressure surface 10*a* of the control piston 10, which is constructed as an annular surface on the second piston part 14 and adjoins the inflow conduit 7, is acted upon by a pilot pressure $p_{vor}$ that prevails in the feed line 32. The maximum fuel pressure in the feed line 32 is predetermined by the pressure-holding spring 11 if no fuel is blown out through the high-pressure valve 4. In operation, the pilot pressure establishes itself in such a way that an equilibrium of all of the forces engaging the control piston 10 prevails, and an edge of the piston surface 10*a* and a lower edge of the outflow conduit 9 are located at approximately the same height, so that the outflow conduit 9 is nearly closed. The size of the inflow throttle 13 and the value of the pilot pressure $p_{vor}$ define a volumetric fuel flow which is supplied to the high-pressure pump 3, and which is equal to the sum of an outlet flow $Q_{ab}$ that is discharged by the high-pressure valve 4 and a feed flow $Q_w$ supplied to the injection valves 6.

The relationship between the actual feed flow $Q_w$, a maximum feed flow $Q_{w,m}$ which depends on the engine rpm, the inflow throttle 13 and the maximum pilot pressure, and the outlet flow $Q_{ab}$ blown off by the high-pressure valve 4, is determined by following relationship:

$$Q_w / Q_{w,m} = \sqrt{1 - \frac{\alpha}{\delta^2}(Q_{ab} / Q_{w,\max})^2} - Q_{ab} / Q_{w,\max}$$

In the equation, the character $\alpha$ indicates a ratio between the first and second pressure surfaces 10*a*, 10*b*. The character $\delta$ is a ratio between the actually selected controllable cross section of the outlet aperture 12 and a reference value for this cross section. In this reference value, and at a value of $\alpha=1$, the pressure $p_{ab}$ in the outlet conduit B downstream of the high-pressure valve 4 would be equal to the maximum possible pilot pressure $p_{vor,m}$ at full blowoff, or in other words if $Q_{ab}=Q_{w,m}$. The pressure regulating valve 2 is constructed to meet the various requirements with the aid of the parameters $\alpha$ and $\delta$.

Figure 2:
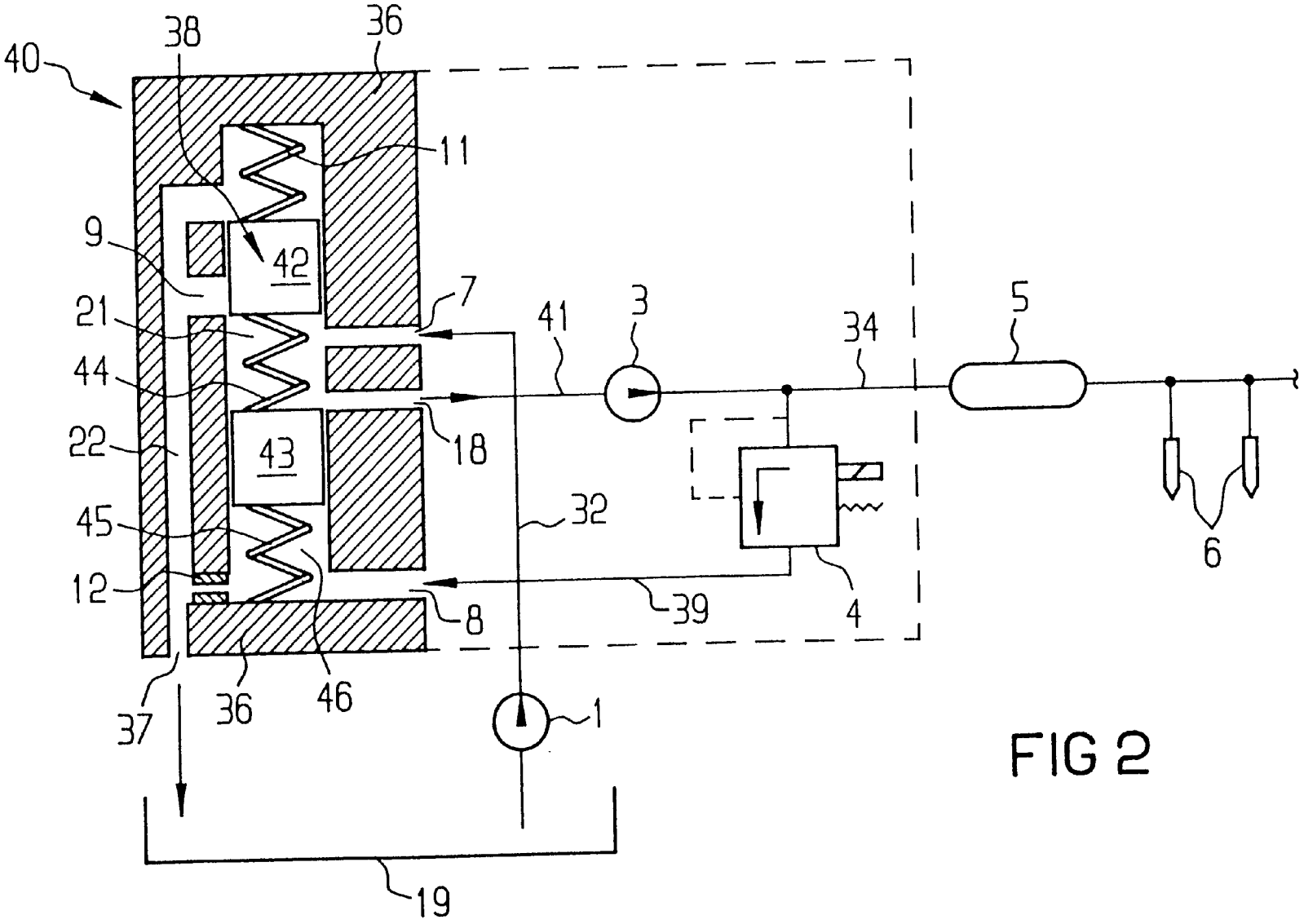
FIG. 2 is a view similar to FIG. 1 of an apparatus for regulating the volumetric fuel flow with simultaneous variation of the throttle cross section and the inflow pressure.

FIG. 2 shows a common rail injection system corresponding to FIG. 1, but in which the volumetric fuel flow delivered to the high-pressure pump 3 is regulated not only by the fuel pressure in the feed line 32 but also by the cross section of a throttle slit 18 with a combined volumetric flow/pressure regulating valve 40. To that end, the feed line 32 of the feed pump 1 is connected to the inflow conduit 7 of the volumetric flow/pressure regulating valve 40. The inflow conduit 7 communicates with a regulating chamber 21, which also communicates with the throttle slit 18 as an outlet. The regulating chamber 21 is part of the piston chamber 38. A feed line 41 extends from the throttle slit 18 to the high-pressure pump 3.

The high-pressure line 34 communicates through the high-pressure valve 4 and the outlet line 39 with the outlet conduit 8 of the volumetric flow/pressure regulating valve 40. The outlet conduit 37 of the volumetric flow/pressure regulating valve 40 is connected to the tank 19.

The structure of the volumetric flow/pressure regulating valve 40 will now be described in further detail: The inflow conduit 7, the throttle slit 18 and the outlet conduit 8, which communicate with the piston chamber 38, are formed in the housing 36 of the volumetric flow/pressure regulating valve 40. The pressure-holding spring 11 is disposed in the upper region of the piston chamber 38. A pressure piston 42 that seals off the piston chamber 38 is introduced into the piston chamber 38 adjacent the pressure-holding spring 11 and above the inflow conduit 7. The pressure piston 42 is resiliently supported against the housing 36 in the longitudinal direction of the piston chamber 38 by the pressure-holding spring 11. A regulating piston 43, which is resiliently coupled to the pressure piston 42 by a regulating spring 44, is disposed in the piston chamber 38, adjacent the throttle slit 18. An outlet chamber 46 is formed in the piston chamber 38, between the regulating piston 43 and the outlet conduit 8. A throttle spring 45 which is provided in the outlet chamber 46, resiliently supports the regulating piston 43 against the housing 36 in the longitudinal direction of the piston chamber 38.

The regulating piston 43 seals off the piston chamber 38. The regulating chamber 21, with which the inflow conduit 7 and the throttle slit 18 communicate, is formed between the pressure piston 42 and the regulating piston 43. The outflow conduit 9 is formed in the piston chamber 38 in the region of the pressure piston 42 and communicates with the outlet conduit 37 through the return conduit 22. The outlet conduit 8 thus communicates with the outlet conduit 37 through the outlet aperture 12.

The mode of operation of the volumetric flow/pressure regulating valve 40 will now be described in further detail: If the fuel pressure in the high-pressure reservoir 5 and thus in the high-pressure line 34 as well is below a predetermined value, then no fuel is delivered through the high-pressure valve 4 and the outlet line 39 to the outlet conduit 8. As a consequence, the regulating piston 43 and the pressure piston 42 are in a position of repose, in which the regulating piston 43 uncovers the throttle slit 18 and the pressure piston 42 closes the outflow conduit 9 far enough to ensure that a maximum pressure in the regulating chamber 21 is established, as determined by the pressure-holding spring 11, the regulating spring 44, the throttle spring 45 and the surface area of the pressure piston 42. Thus on one hand the volumetric fuel flow pumped by the feed pump 1 flows through the feed line 32, the inflow conduit 7, the regulating chamber 21, the throttle slit 18 and the supply line 41 to the high-pressure pump 3. The excess fuel pumped by the feed pump 1 is also returned through the outflow conduit 9 and the outlet conduit 37 to the tank 19.

If the fuel pressure in the high-pressure reservoir 5 and thus in the high-pressure line 34 is above the desired value, then fuel is carried through the high-pressure valve 4 and the outlet line 39 to the outlet conduit 8 and is delivered through the outlet chamber 46, the outlet aperture 12 and the outlet conduit 37 to the tank 19. As a consequence, a fuel pressure builds up in the outlet chamber 46 that displaces the regulating piston 43 upward in the direction of the pressure piston 42, so that on one hand the opening cross section of the throttle slit 18 is decreased by the regulating piston 43, and moreover a force is exerted on the pressure piston 42 through the regulating spring 44, so that the pressure piston 42 is displaced in the direction of the pressure-holding spring 11 and thus enlarges the open cross section between the regulating chamber 21 and the outflow conduit 9, and as a result a low pressure is established in the regulating chamber 21. Due to the reduction of the pressure in the regulating chamber 21 and the narrowing of the cross section of the throttle 18, a larger portion of the volumetric fuel flow that is pumped by the feed pump 1 through the feed line 32 into the regulating chamber 21 is returned to the tank through the outflow conduit 9 and the outlet conduit 37, so that a smaller volumetric fuel flow is made available to the high-pressure pump 3 by the feed pump 1.

The volumetric fuel flow that is made available by the feed pump 1 to the high-pressure pump 3 is regulated as a function of the fuel pressure in the outlet chamber 46. The fuel pressure in the outlet chamber 46 rises with the volumetric fuel flow that is discharged by the high-pressure valve 4.

The pressure conditions will now be explained in further detail: The pressure-holding spring 11 specifies a maximum pilot pressure $P_{v,m}$ which prevails in the regulating chamber 21 and thus in the feed or supply line 41. The outlet flow $Q_{ab}$ occurring at the high-pressure valve 4 generates a pressure $p_{ab}$ upstream of the outlet aperture 12, which pressure acts upon the throttle piston 43. With the aid of the throttle spring 45, the position of the throttle piston 43 is adjusted in such a way that the throttle piston 43 uncovers the throttle slit 18 completely in the absence of an outlet flow. The regulating spring 44 transmits the pressure $p_{ab}$ through the position of the throttle piston 43 to the pressure regulating piston 42.

Advantageously, the springs and the pistons are dimensioned identically, so that errors in assembly are avoided. It is also advantageous if the volumetric flow/pressure regulating valve 40 forms a unit with the high-pressure pump 4.

In the case of the ensuing mode of observation, it is assumed that all of the springs have the same spring constant and that the regulating spring 44 is relaxed at maximum pilot pressure and in the absence of an outlet flow. This dictates corresponding prestressed lengths of the springs. The pilot pressure is then compensated for through the prestressing of the pressure-holding spring 11 and of the throttle spring 45.

In this situation, the throttle slit 18 has also just now been uncovered completely by the regulating piston 43.

The relationship between the feed flow $Q_w$ that is supplied to the injection valve 6, the maximum possible feed flow $Q_{w,m}$ and the outlet flow $Q_{ab}$, wherein the maximum possible feed flow is determined by the engine rpm, the cross section of the throttle slit 18 and the maximum pilot pressure, is defined by the following equation:

$$Q_w / Q_{w,m} = \left(1 - \frac{1}{\delta^2 \lambda}(Q_{ab} / Q_{w,m})^2\right)\sqrt{1 - \frac{1}{\delta^2}(Q_{ab} / Q_{w,\max})^2} - Q_{ab} / Q_{w,m}$$

The ratio between the actual value of the throttle cross section of the outlet aperture 12 and a reference variable is defined by the character $\delta$. If the maximum feed flow $Q_{w,m}=Q_{ab}$ is blown off, then the pilot pressure $p_{ab}$ is equal to the maximum possible pilot pressure $p_{v,m}$. The character $\lambda$ indicates the ratio between the actual slit length of the throttle slit 18 parallel to the direction of motion of the regulating piston 43 and a reference length. The reference length of the throttle slit 18 is such that upon blowoff of $Q_{ab}=Q_{w,m}$ the resultant pressure is $p_{ab}=p_{v,m}$ and the regulating piston 43 has just been thrust all the way past the throttle slit 18.

The width of the throttle slit in each case is adapted by the selection of the parameter $\lambda$ in such a way that the total area of the throttle slit remains the same. Thus the maximum feed flow $Q_{w,m}$ remains the same as well. With the aid of the equation given, it is possible to check how the actual feed flow is adapting itself to a desired feed flow by way of various parameters $\delta$ and $\lambda$.

Figure 3:
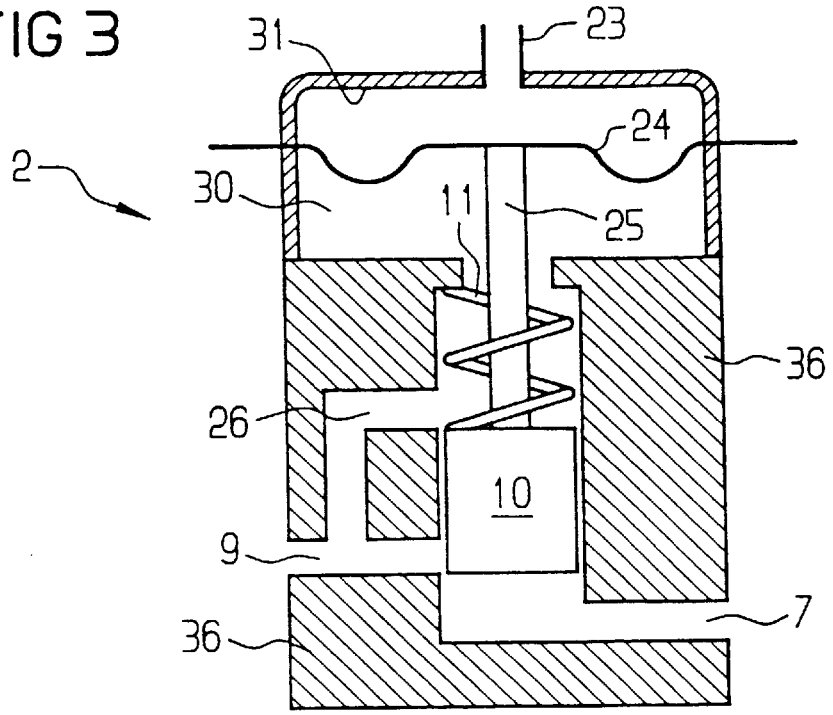
FIG. 3 is a cross-sectional view of a pressure regulating valve with a diaphragm.

FIG. 3 shows a first variant of a pressure regulating valve 2, which has a housing 36 in which an inflow conduit 7 is provided that communicates with an outflow conduit 9. However, the opening cross section between the outflow conduit 9 and the inflow conduit 7 is regulated by a control piston 10 that is resiliently supported against the housing 36 through a pressure-holding spring 11 in such a way that the spring force of the pressure-holding spring 11 counter-acts an opening of the opening cross section. Moreover, the control piston 10 is connected through a piston rod 25 to a diaphragm 24. The diaphragm 24 and one part of the housing 36 form a reference chamber 31 that has a connection 23.

The mode of operation of the pressure regulating valve shown in FIG, 3 will now be described in further detail: The inflow conduit 7 is connected, for instance, to the connecting line 33 of the feed line 32 corresponding to FIG. 1, and the outflow conduit 9 communicates directly with a tank 19. The connection 23 communicates with the pressure chamber of a turbocharger of an internal combustion engine, for instance. The pressure generated by the turbocharger presses the diaphragm 24 downward, so that the control piston 10 is likewise pressed downward. In this way, the pressure prevailing in the inflow conduit 7 is regulated through the force acting upon the control piston 10 and the surface area of the control piston 10.

Figure 4:
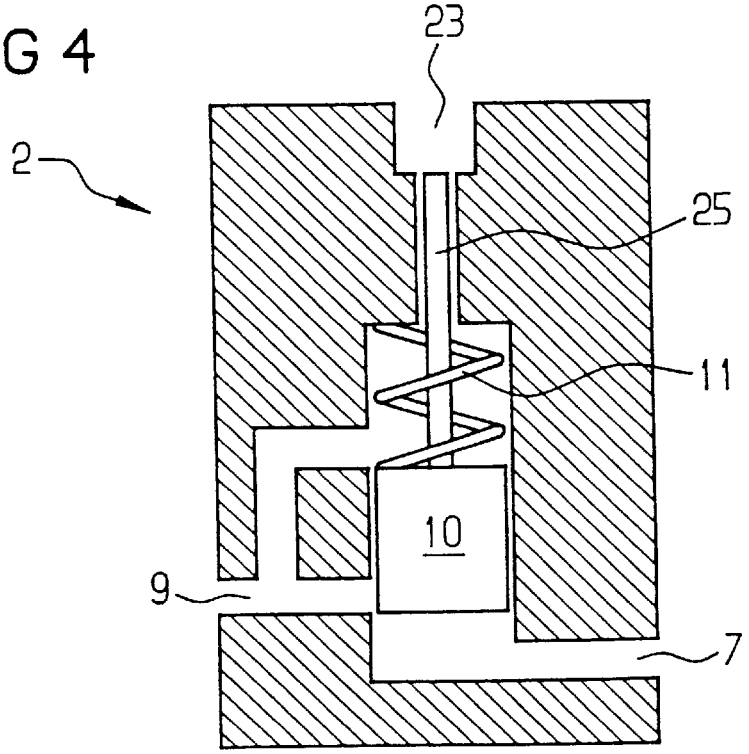
FIG. 4 is a cross-sectional view of a pressure regulating valve with a stepped piston.

FIG. 4 shows a further embodiment of a pressure regulating valve 2, corresponding to FIG. 3, but in which the diaphragm 24 is omitted, and a reference pressure, in particular a pressure in a high-pressure reservoir of the injection system, acts directly on the piston rod 25. It is also possible, instead of the diaphragm 24, to provide an electromagnet that acts upon the control piston 10 with a corresponding force.

We claim:

1. In a method for regulating a volumetric fuel flow delivered by a feed pump to a high-pressure pump connected to a high-pressure reservoir communicating through an injection line with injection valves, the improvement which comprises:

draining fuel from the high-pressure reservoir, beyond a limit pressure, through a high-pressure valve; and regulating the volumetric fuel flow by varying fuel pressure between the feed pump and the high-pressure pump and by varying a cross section of a connecting line between the feed pump and the high-pressure pump as a function of a quantity of the fuel drained out.

2. In a system having a feed pump and a high-pressure pump, an apparatus for regulating a volumetric fuel flow delivered by the feed pump to the high-pressure pump, comprising:

a housing having a piston chamber therein and having a reference conduit therein communicating with said piston chamber;

an inflow conduit and an outflow conduit communicating with said piston chamber;

a movable control piston in said piston chamber, said control piston having a first piston part and a second piston part connected to said first piston part;

a first spring element resiliently supporting said first piston part;

a second spring element interconnecting said second piston part and said first piston part;

a third spring element resiliently supporting said second piston part counter to a motion in the direction of said reference conduit;

a regulating chamber disposed between said first and second piston parts in said piston chamber and sealed off by said first and second piston parts;

said first piston part sealing off said reference conduit from said piston chamber;

said second piston part having a position of repose opening a predeterminable connecting cross section between said inflow conduit and said outflow conduit;

said first piston part being displaced with increasing pressure in said reference conduit for exerting a force upon said second piston part displacing said second piston part to increase said connecting cross section between said outflow conduit and said inflow conduit;

said inflow conduit discharging into said regulating chamber and said outlet conduit leading away from said regulating chamber;

said first and second piston parts and said first, second and third spring elements causing said outlet conduit to be opened to a predeterminable cross section as a function of fuel pressure in said reference conduit; and said outflow conduit opening to a predeterminable further cross section.

3. The apparatus according to claim 2, including a supply line connecting the feed pump to the high-pressure pump, a connecting line connecting said inflow conduit to the connecting line, a high-pressure reservoir, an outlet line connected between said high-pressure reservoir and said reference conduit, a high-pressure valve in said outlet line, and a tank with which said outflow conduit and said reference conduit communicate.

4. The apparatus according to claim 2, including a supply line connected to the feed pump and to said inflow conduit, a supply line connected from said outlet conduit to the high-pressure pump, an outlet line connected between a high-pressure region of an injection system and said reference conduit, a high-pressure valve in said outlet line, and a tank with which said outflow line and said reference conduit communicate.

5. The apparatus according to claim 2, including a throttle through which said reference conduit communicates with said outflow conduit.

6. In a system having a feed pump and a high-pressure pump, an apparatus for regulating a volumetric fuel flow delivered by the feed pump to the high-pressure pump, comprising:

a housing having a piston chamber therein and having a reference conduit therein communicating with said piston chamber;

an inflow conduit and an outflow conduit communicating with said piston chamber;

a movable control piston in said piston chamber, said control piston having a first piston part and a second piston part connected to said first piston part;

a supply line connecting the feed pump to the high-pressure pump;

a connecting line connecting said inflow conduit to the connecting line;

a high-pressure reservoir;

an outlet line connected between said high-pressure reservoir and said reference conduit;

a high-pressure valve in said outlet line; and a tank with which said outflow conduit and said reference conduit communicate;

said first piston part sealing off said reference conduit from said piston chamber;

said second piston part having a position of repose opening a predeterminable connecting cross section between said inflow conduit and said outflow conduit;

said first piston part being displaced with increasing pressure in said reference conduit for exerting a force upon said second piston part displacing said second piston part to increase said connecting cross section between said outflow conduit and said inflow conduit;

said second piston part has a larger diameter than said first piston part;

said reference conduit and said inflow conduit define a first region therebetween;

said first piston part protrudes into said reference conduit and seals off said piston chamber in said first region;

said inflow conduit discharges into said piston chamber in a second region;

said piston chamber has a larger diameter than said first piston part in said second region;

said first piston part extends beyond said second region;

said first piston part is connected directly to said second piston part;

said second piston part having a size within said piston chamber for sealing off said piston chamber with said second piston part;

said control piston has a position of repose in which said second piston part partly opens said outflow conduit; and including a spring element connected to said control piston;

said control piston being displaceable by fuel pressure in said reference conduit counter to said spring element, causing said second piston part to open a larger opening cross section between said outflow conduit and said piston chamber.

7. The apparatus according to claim 6, including a throttle through which said reference conduit communicates with said outflow conduit.

* * * * *